US007578687B2

(12) United States Patent
Liu et al.

(10) Patent No.: US 7,578,687 B2
(45) Date of Patent: Aug. 25, 2009

(54) COMPLEX COUPLER FOR COLD CATHODE FLUORESCENT LAMP

(75) Inventors: Kuang-Yung Liu, Hukou Township, Hsinchu County (TW); Chen-Hsuan Hsieh, Hukou Township, Hsinchu County (TW); Che-Chen Ou, Hukou Township, Hsinchu County (TW)

(73) Assignee: SOA Technology Co., Ltd., Hsinchu County (TW)

( * ) Notice: Subject to any disclaimer, the term of this patent is extended or adjusted under 35 U.S.C. 154(b) by 0 days.

(21) Appl. No.: 12/289,104

(22) Filed: Oct. 21, 2008

(65) Prior Publication Data

US 2009/0117767 A1 May 7, 2009

(30) Foreign Application Priority Data

Nov. 2, 2007 (TW) ..... 96141607 A

(51) Int. Cl.
*H01R 33/08* (2006.01)

(52) U.S. Cl. ..... 439/226

(58) Field of Classification Search ..... 439/226, 439/242, 227, 228, 229, 232, 336, 558; 362/225, 362/227; 313/318.03
See application file for complete search history.

(56) References Cited

U.S. PATENT DOCUMENTS 1,332,867 A * 3/1920 Frankel ..... 439/336
4,980,602 A * 12/1990 Eldridge ..... 313/318.04
6,494,730 B1 * 12/2002 Yan ..... 439/226
7,101,229 B2 * 9/2006 Tufano et al. ..... 439/642

* cited by examiner

*Primary Examiner*—Chandrika Prasad
(74) *Attorney, Agent, or Firm*—Rosenberg, Klein & Lee

(57) ABSTRACT

A complex coupler for cold cathode fluorescent lamp (CCFL) is used as a lamp lead wire coupling terminal, which includes a main body, a CCFL socket, and a cable socket. The main body is in the shape of an elongated column with a complex structure consisting of an inner conductive body and an outer enclosing insulative layer. The main body has a lamp coupling surface, on which the CCFL socket is formed for receiving an end of a CCFL and a lamp lead wire provided on that end of the CCFL, and a conductor coupling surface, on which the conductor socket is formed for a cable to connect thereto. The lamp lead wire of the CCFL and the cable can be electrically connected to each other via the lamp lead wire coupling terminal.

7 Claims, 11 Drawing Sheets

COMPLEX COUPLER FOR COLD CATHODE FLUORESCENT LAMP

FIELD OF THE INVENTION

The present invention relates to a cold cathode fluorescent lamp, and more particularly, to a complex coupler for a cold cathode fluorescent lamp.

BACKGROUND OF THE INVENTION

When a high-voltage current is applied to the electrodes of a cold cathode fluorescent lamp (CCFL), electrons are released from the cathode to collide against mercury atoms inside the CCFL. The mercury atoms being collided would release surplus energy in the form of ultraviolet light. The ultraviolet light is absorbed by a fluorescent powder coated in the CCFL and then transformed into visible light. From the mechanism of the generation of light, it is known that the CCFL is characterized by high brightness and low heat production, and CCFL has been widely applied in many electronic devices as a light source, such as being used in the backlight module of a liquid crystal display (LCD).

Taiwan Invention Publication No. 200720788 discloses a lamp tube fixing device for a cold cathode fluorescent lamp. The lamp tube fixing device mainly includes a base, on one side of which a plurality of spaced collars are formed.

In each of the collars connected to the base, a protrusion is formed at each of two ends of the collar, and a passage is formed between the two protrusions. The collar and the protrusions formed at two ends thereof together define an annular receiving space. The CCFL in the backlight module can be extended through the passages between the protrusions, so that the CCFL is retained in the receiving spaces of the collars.

A plurality of retaining sections are formed on another side of the base, and a plurality of through holes are formed on a bottom of an enclosure of the backlight module corresponding to the retaining sections on the base, such that the retaining sections on the base can be fixedly retained in the through holes on the bottom of the backlight module enclosure.

When the CCFL has been retained in the collars on the base, the retaining sections on the base are then engaged with the through holes on the bottom of the backlight module enclosure, so that the CCFL is also fixed to the bottom of the enclosure. That is, with the prior art lamp tube fixing device, the lamp tube of a CCFL can be fixed in place in a backlight module.

While the above-described prior art lamp tube fixing device allows a CCFL to be fixed in a backlight module enclosure by extending the CCFL through the collars on the base of the fixing device and engaging the retaining sections on the base with through holes on the bottom of the backlight module enclosure, the prior art lamp tube fixing device does not provide a voltage source that is very important for the CCFL to emit light. In addition, the collars provided on the base of the lamp tube fixing device also form a limitation to the arrangement of the CCFL in the backlight module.

SUMMARY OF THE INVENTION

A primary object of the present invention is to provide a CCFL coupling device comprised of a complex structure, so that one single CCFL coupling device can provide the functions of electrical connection and electrical insulation at the same time.

Another object of the present invention is to provide a multipurpose coupler for electrically connecting with a CCFL lamp body while fixing the lamp body in place.

To fulfill the above objects, the present invention provides a complex coupler for cold cathode fluorescent lamp (CCFL). The complex coupler is used as a lamp lead wire coupling terminal, which includes a main body, a CCFL socket, and a cable socket. The main body is in the shape of an elongated column with a complex structure consisting of an inner conductive body and an outer enclosing insulative layer.

The main body has a lamp coupling surface, on which the CCFL socket is formed for receiving an end of a CCFL and a lamp lead wire provided on that end of the CCFL, and a conductor coupling surface, on which the conductor socket is formed for a cable to connect thereto. The lamp lead wire of the CCFL and the cable can be electrically connected to each other via the lamp lead wire coupling terminal.

With the technical means adopted by the present invention, a complex coupler for CCFL is provided. The complex coupler is comprised of a complex structure consisting of an inner conductive body and an outer enclosing insulative layer, and is useful in electrically connecting a lamp lead wire held in a lamp lead wire holding section of a CCFL socket on the complex coupler to a metal stem on a connecting head of a cable inserted into a conductor socket on the complex coupler.

The CCFL socket provided on the complex coupler includes a lamp body holding section for receiving an end of a CCFL lamp body and a lamp lead wire holding section for receiving a lamp lead wire provided on that end of the CCFL lamp body. With this configuration, the complex coupler for CCFL according to the present invention not only enables electrical connection of the lamp lead wire to a cable, but also helps in easy installation of the CCFL.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with some preferred embodiments thereof with reference to the accompanying drawings.

Figure 1:
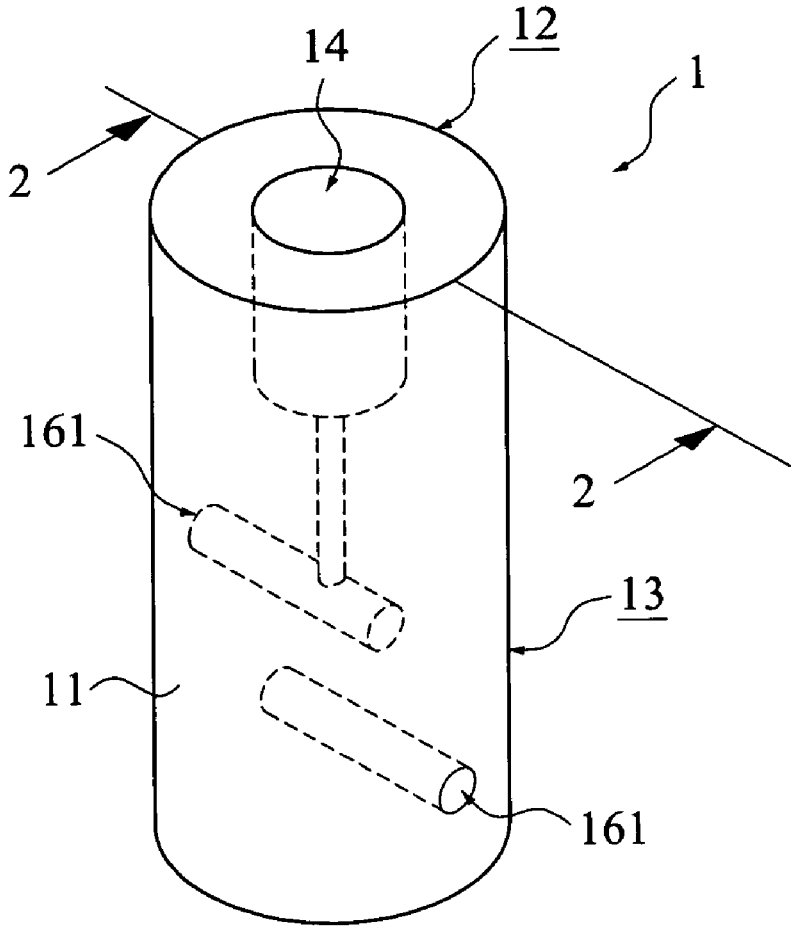
FIG. 1 is a perspective view of a complex coupler for cold cathode fluorescent lamp according to a first embodiment of the present invention.

Please refer to FIG. 1, in which a complex coupler for cold cathode fluorescent lamp (CCFL) according to a first embodiment of the present invention is shown. In the present invention, the complex coupler is directed to a lamp lead wire coupling terminal 1.

The lamp lead wire coupling terminal 1 has a main body 11, which is in the shape of an elongated column with a complex structure, and has a lamp coupling surface 12 and an adjacent conductor coupling surface 13.

A CCFL socket 14 is formed on the lamp coupling surface 12, which forms an end surface of the main body 11; and two offset conductor sockets 161, 162 for receiving cables therein are formed on the conductor coupling surface 13, which forms a peripheral surface of the main body 11.

Figure 2:
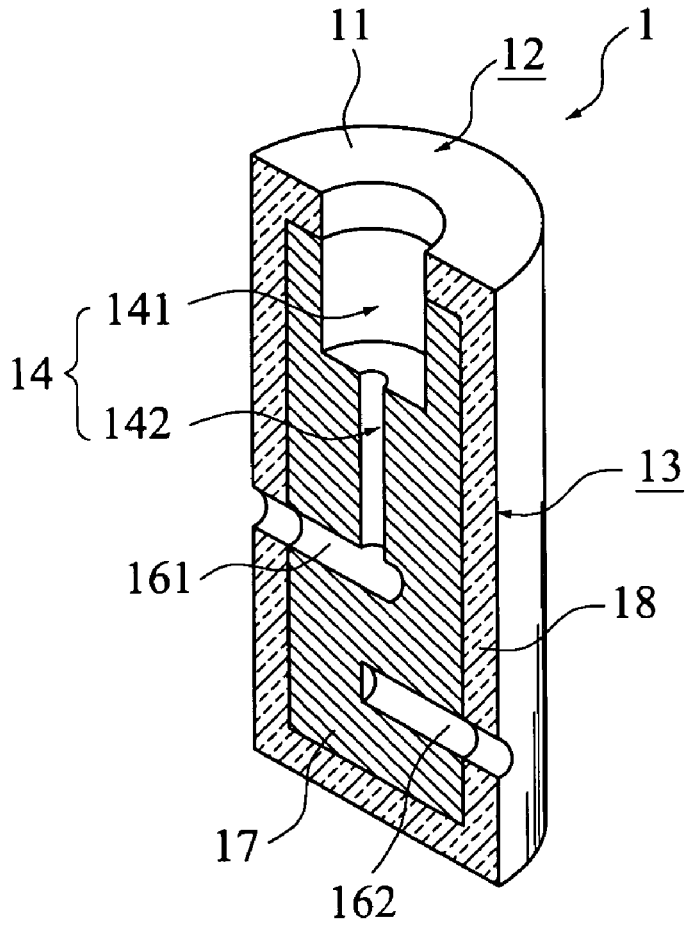
FIG. 2 is a perspective sectional view taken along line 2-2 of FIG. 1.

As can be seen from FIG. 2, which is a perspective sectional view taken along line 2-2 of FIG. 1, the main body 11 of the lamp lead wire coupling terminal 1 is formed with a complex structure consisting of an inner conductive body 17 and an outer enclosing insulative layer 18.

The CCFL socket 14 is formed on the lamp coupling surface 12 of the main body 11, and includes a lamp body holding section 141 and a lamp lead wire holding section 142. The lamp lead wire holding section 142 is extended from and communicates with an inner end of the lamp body holding section 141. Moreover, the lamp body holding section 141 has an internal diameter larger than that of the lamp lead wire holding section 142.

The lamp body holding section 141 of the CCFL socket 14 is inward extended through the outer enclosing insulative layer 18 into the inner conductive body 17. And, the lamp lead wire holding section 142 of the CCFL socket 14 is formed behind the lamp body holding section 141 to thereby locate in the inner conductive body 17.

The conductor sockets 161, 162 are formed on the conductor coupling surface 13 of the main body 11, and are inward extended through the outer enclosing insulative layer 18 into the inner conductive body 17.

Figure 3:
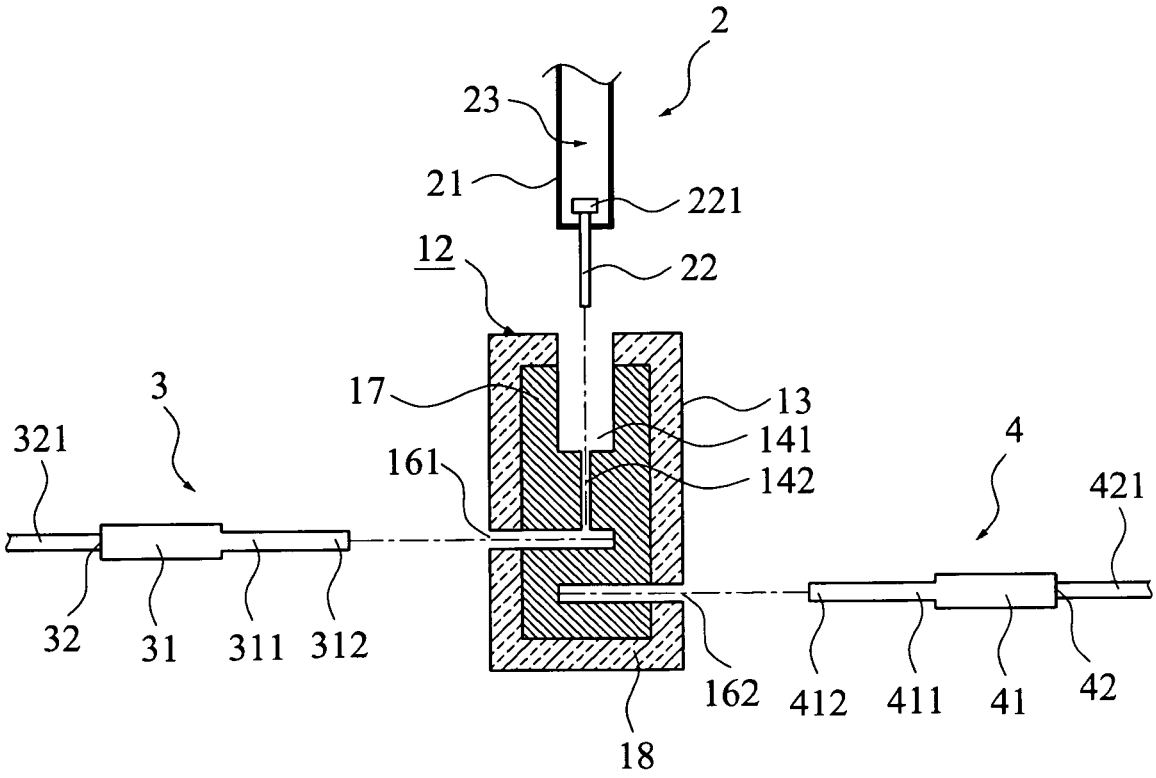
FIG. 3 is a sectional view showing the use of the complex coupler of FIG. 1 to interconnect a cold cathode fluorescent lamp and two conductors.

Please refer to FIG. 3 that is a sectional view showing the use of the complex coupler of FIG. 1 to interconnect a CCFL 2 and two conductors. The CCFL 2 has a lamp body 21, two opposite ends of which are each provided with a lamp lead wire 22, and are each inserted into and held in the CCFL socket 14 on one lamp lead wire coupling terminal 1. Two conductor connecting heads 3, 4 are inserted into the conductor sockets 161, 162, respectively, on the lamp lead wire coupling terminal 1.

When an end of the CCFL 2 is inserted into the CCFL socket 14 on the lamp lead wire coupling terminal 1, the lamp body 21 of the CCFL 2 and the lamp lead wire 22 provided at that end are held in the lamp body holding section 141 and the lamp lead wire holding section 142 of the CCFL socket 14, respectively.

The conductor connecting heads 3, 4 each includes a conductor insertion segment 31, 41. An end of the conductor insertion segment 31, 41 is formed into a metal insertion stem 311, 411. A free end of the metal insertion stem 311, 411 functions as an insertion end 312, 412. Another end of the conductor insertion segment 31, 41 opposite to the metal insertion stem 311, 411 is a conductor welding end 32, 42, to which an extended conductor 321, 421 is welded.

The conductor connecting heads 3, 4 are respectively inserted into the conductor sockets 161, 162 provided on the lamp lead wire coupling terminal 1, so that the insertion ends 312, 412 of the metal insertion stems 311, 411 are received in the conductor sockets 161, 162, respectively.

In the first embodiment of the present invention, the lamp lead wire holding section 142 of the CCFL socket 14 and the conductor sockets 161, 162 are formed in the inner conductive body 17 of the main body 11, such that the lamp lead wire 22 held in the lamp lead wire holding section 142 and the extended conductor 321 connected to the conductor connecting head 3 are electrically connected to each other via the inner conductive body 17.

Further, the lamp body 21 of the CCFL 2 internally defines a receiving space 23; and the lamp lead wire 22 is provided at each of two opposite ends of the CCFL 2 to partially extend into the receiving space 23 of the lamp body 21.

An end of the lamp lead wire 22 being extended into the receiving space 23 is provided with an electrode 221. Via the lamp lead wire 22 held in the lamp lead wire holding section 142 and the metal insertion stem 311 of the conductor insertion segment 31 inserted into the conductor socket 161, the electrode 221 can be electrically connected to the extended conductor 321 having an electric property corresponding to a polarity of the electrode 221.

Figure 4:
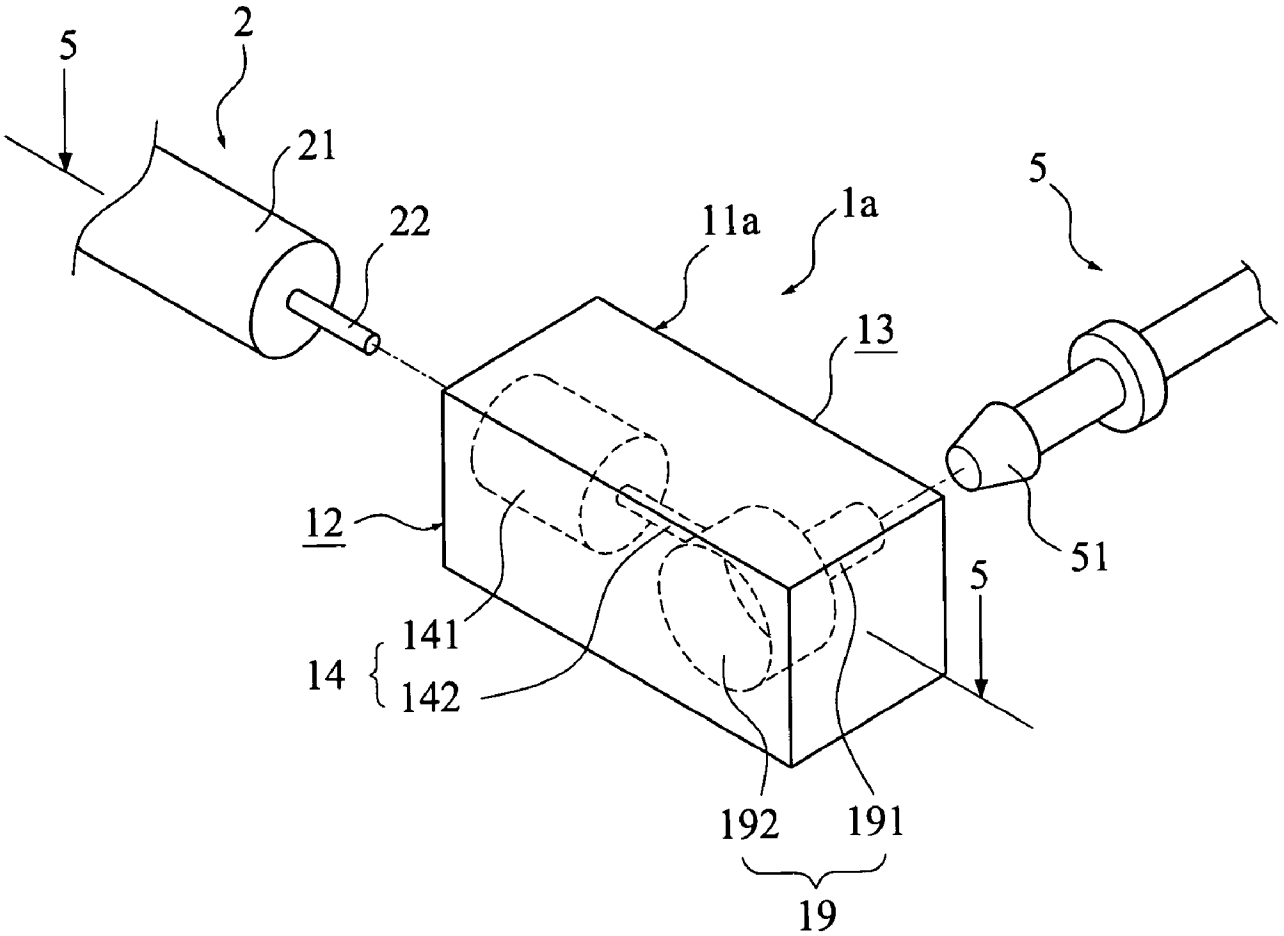
FIG. 4 is a perspective view of a complex coupler for cold cathode fluorescent lamp according to a second embodiment of the present invention.

FIG. 4 is a perspective view of a complex coupler for CCFL according to a second embodiment of the present invention. In the second embodiment, the complex coupler is a lamp lead wire coupling terminal la having a main body 11*a*. The main body 11*a* has a lamp coupling surface 12 and an adjacent conductor coupling surface 13.

A CCFL socket 14 is formed on the lamp coupling surface 12 of the main body 11*a*, and includes a lamp body holding section 141 for receiving an end of a CCFL lamp body 21 therein and a lamp lead wire holding section 142 for receiving a lamp lead wire 22 therein.

A conductor socket 19 is formed on the conductor coupling surface 13 of the main body 11*a*, and includes a neck section 191 and an expanded guide hook holding section 192. A conductor 5 can be inserted into the guide hook holding section 192 of the conductor socket 19 via the neck section 191 with a guide hook 51 on the conductor 5 being received in and held to the guide hook holding section 192.

Figure 5:
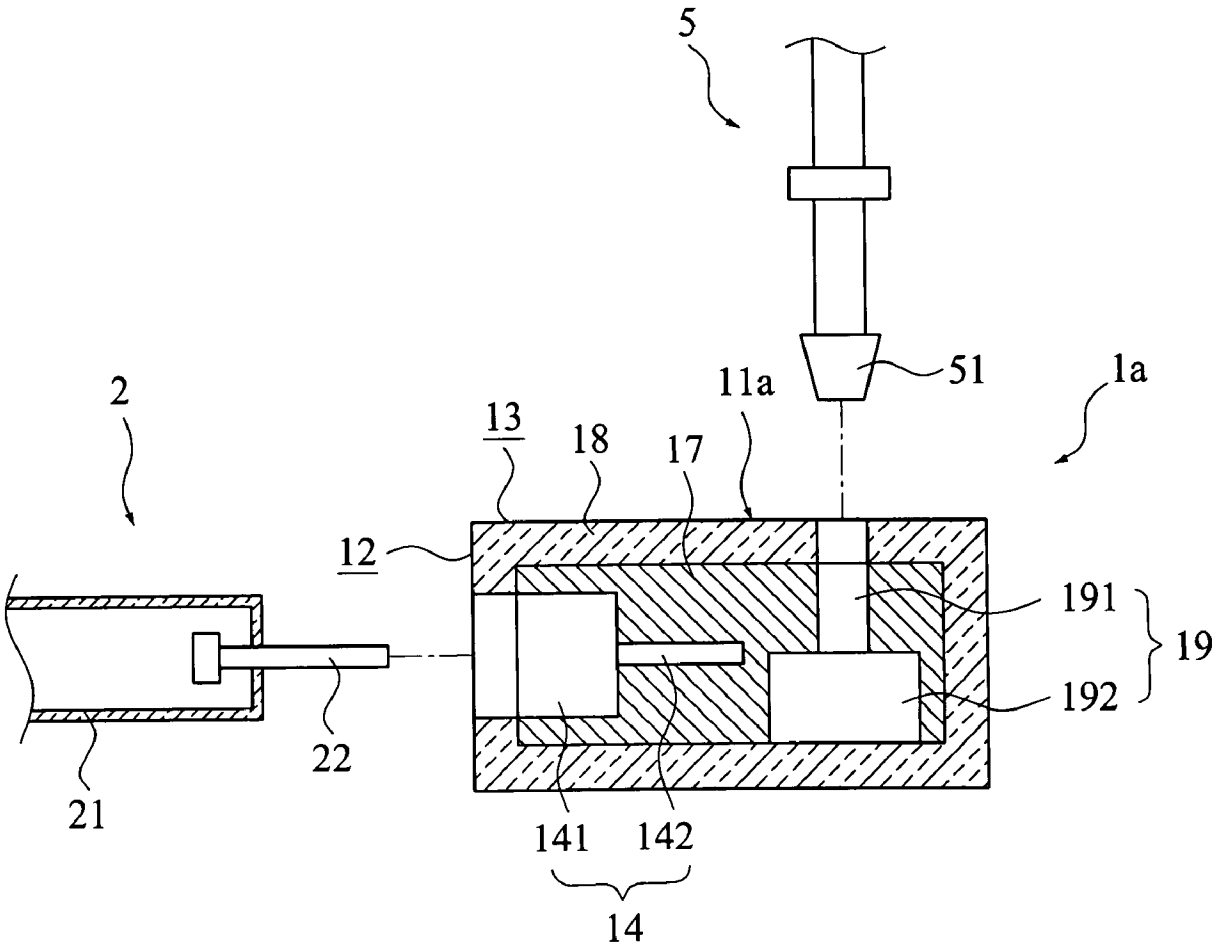
FIG. 5 is a sectional view taken along line 5-5 of FIG. 4.
Figure 6:
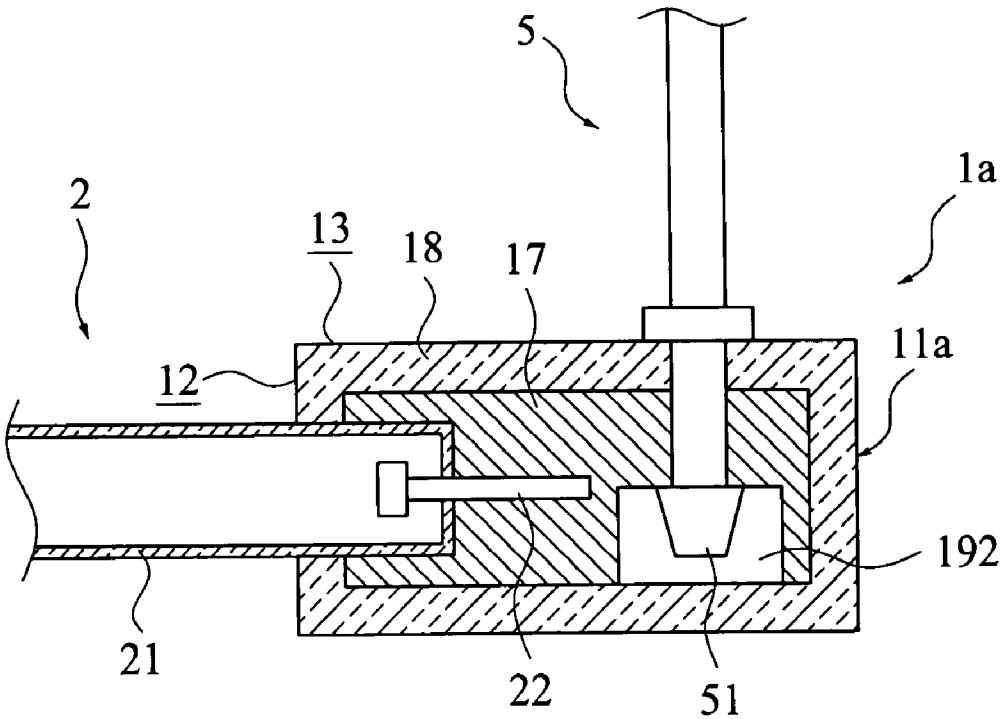
FIG. 6 is a sectional view showing the use of the complex coupler of FIG. 4 to interconnect a cold cathode fluorescent lamp and a conductor.

As can be seen from FIGS. 5 and 6, the main body 11*a* of the lamp lead wire coupling terminal 1*a* includes an inner conductive body 17 and an outer enclosing insulative layer 18 enclosing the conductive body 17 therein.

The lamp body holding section 141 of the CCFL socket 14 is inward extended through the outer enclosing insulative layer 18 into the inner conductive body 17, and the lamp lead wire holding section 142 is formed in the inner conductive body 17. The neck section 191 of the conductor socket 19 is inward extended through the outer enclosing insulative layer 18 into the inner conductive body 17, and the guide hook holding section 192 of the conductor socket 19 is formed in the inner conductive body 17.

Figure 7:
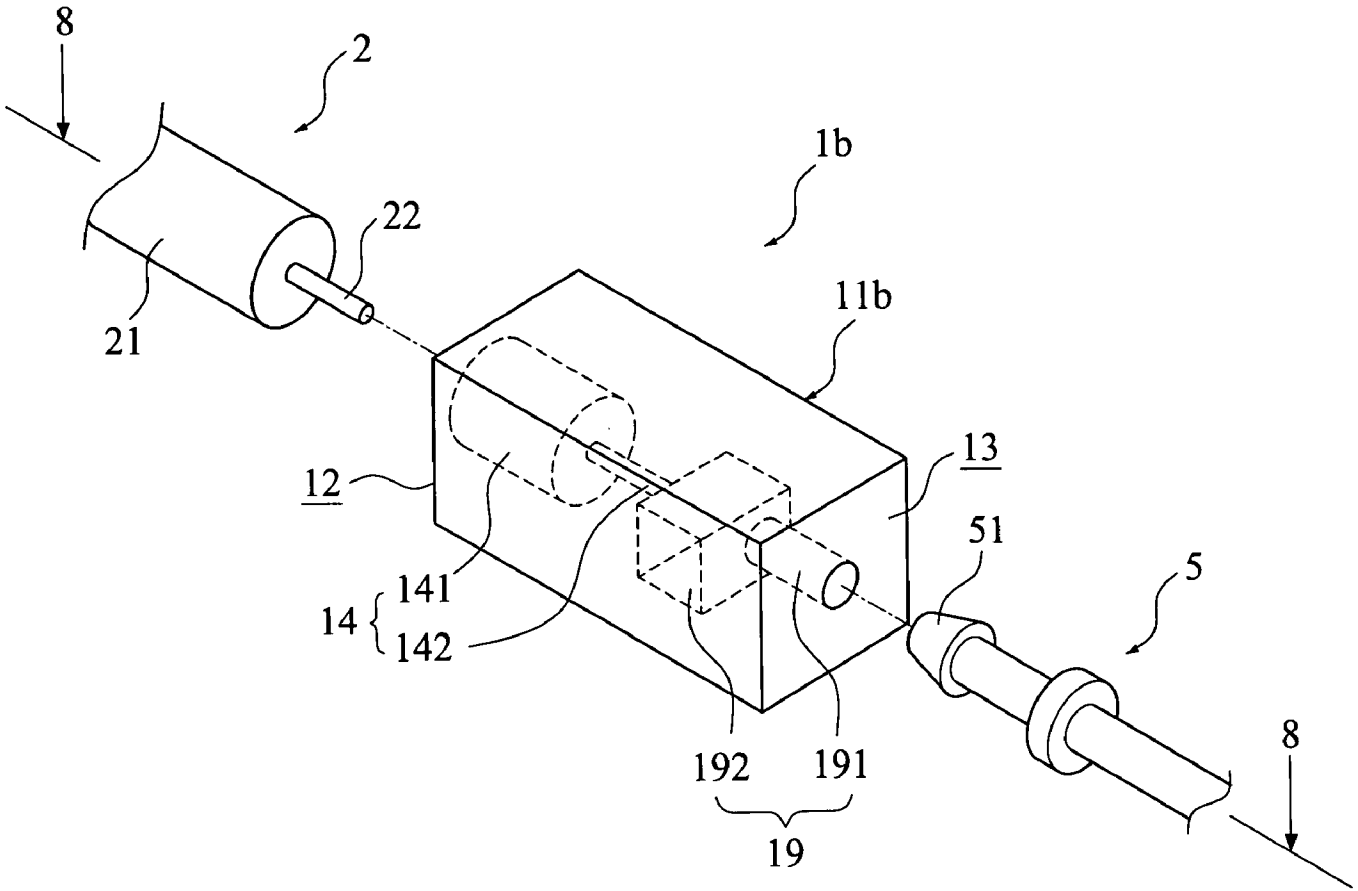
FIG. 7 is a perspective view of a complex coupler for cold cathode fluorescent lamp according to a third embodiment of the present invention.

FIG. 7 is a perspective view of a complex coupler for CCFL according to a third embodiment of the present invention. In the third embodiment, the complex coupler is a lamp lead wire coupling terminal 1*b* having a main body 11*b*. The main body 11*b* has a lamp coupling surface 12 and an opposite conductor coupling surface 13.

A CCFL socket 14 is formed on the lamp coupling surface 12 of the main body 11*b*, and includes a lamp body holding section 141 for receiving an end of a CCFL lamp body 21 therein and a lamp lead wire holding section 142 for receiving a lamp lead wire 22 therein.

A conductor socket 19 is formed on the conductor coupling surface 13 of the main body 11*b*, and includes a neck section 191 and an expanded guide hook holding section 192. A conductor 5 can be inserted into the guide hook holding section 192 of the conductor socket 19 via the neck section 191 with a guide hook 51 on the conductor 5 being received in and held to the guide hook holding section 192.

Figure 8:
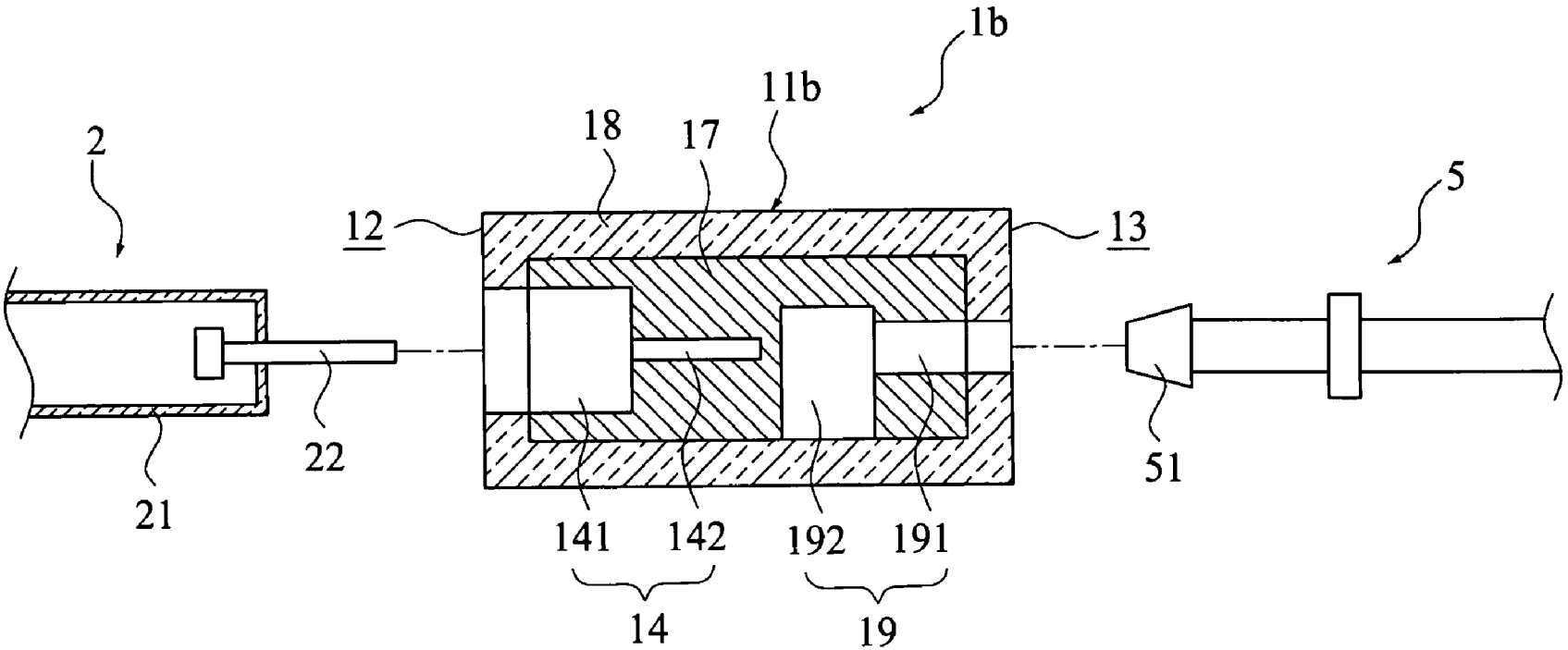
FIG. 8 is a sectional view taken along line 8-8 of FIG. 7.
Figure 9:
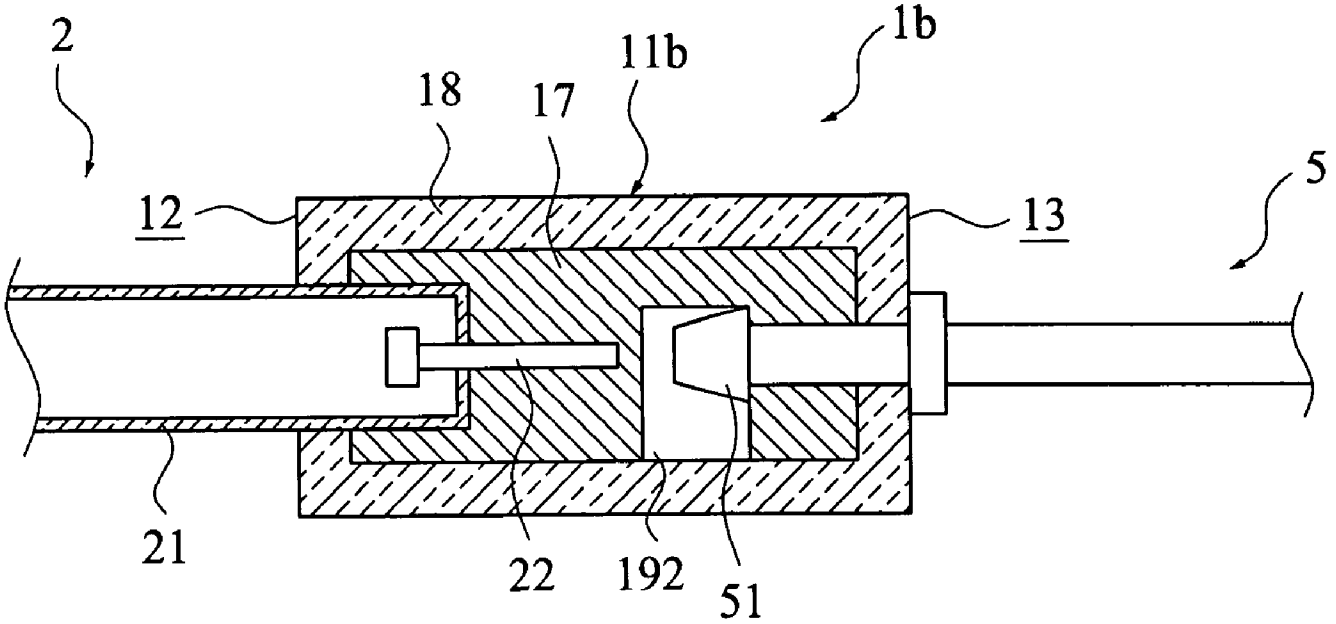
FIG. 9 is a sectional view showing the use of the complex coupler of FIG. 7 to interconnect a cold cathode fluorescent lamp and a conductor.

As can be seen from FIGS. 8 and 9, the main body 11*b* of the lamp lead wire coupling terminal 1*b* includes an inner conductive body 17 and an outer enclosing insulative layer 18 enclosing the conductive body 17 therein.

The lamp body holding section 141 of the CCFL socket 14 is inward extended through the outer enclosing insulative layer 18 into the inner conductive body 17, and the lamp lead wire holding section 142 is formed in the inner conductive body 17.

The neck section 191 of the conductor socket 19 is inward extended through the outer enclosing insulative layer 18 into the inner conductive body 17, and the guide hook holding section 192 of the conductor socket 19 is formed in the inner conductive body 17.

In the third embodiment of the present invention, the lamp lead wire holding section 142 of the CCFL socket 14 and the guide hook holding section 192 of the conductor socket 19 are connected to the inner conductive body 17 of the main body 11*b*, such that the lamp lead wire 22 held in the lamp lead wire holding section 142 can be electrically connected to the conductor 5 held in the guide hook holding section 192 via the inner conductive body 17.

Figure 10:
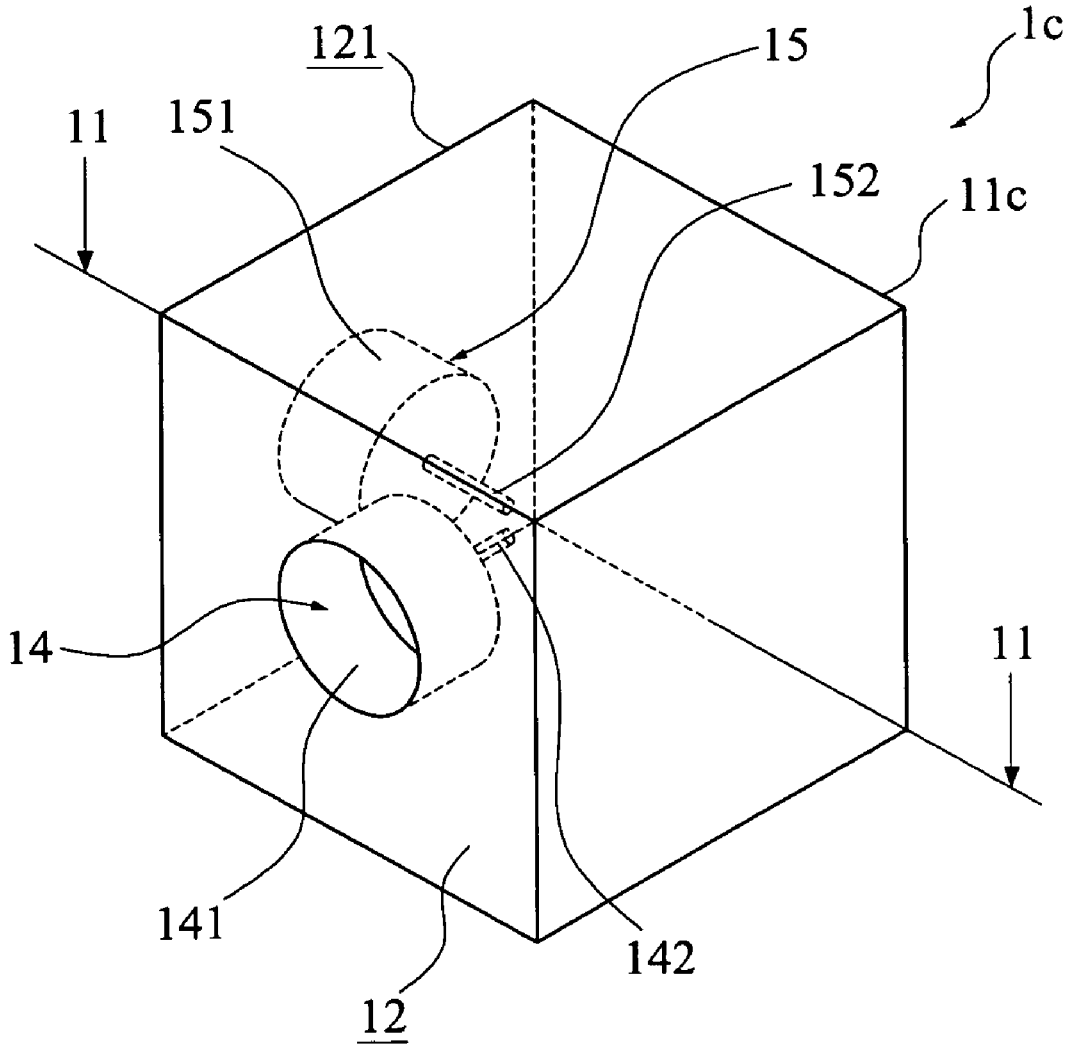
FIG. 10 is a perspective view of a complex coupler for cold cathode fluorescent lamp according to a fourth embodiment of the present invention.

Please refer to FIG. 10 that is a perspective view of a complex coupler for CCFL according to a fourth embodiment of the present invention. In the fourth embodiment, the complex coupler is a lamp lead wire coupling terminal 1*c* having a main body 11*c*. The main body 11*c* has two adjoining lamp coupling surfaces 12, 121, on each of which a CCFL socket 14, 15 is formed.

The CCFL sockets 14, 15 each have a lamp body holding section 141, 151 for receiving an end of a CCFL lamp body 21, 61 and a lamp lead wire holding section 142, 152 for receiving a lamp lead wire 22, 62 provided on that end of the lamp body 21, 61.

Figure 11:
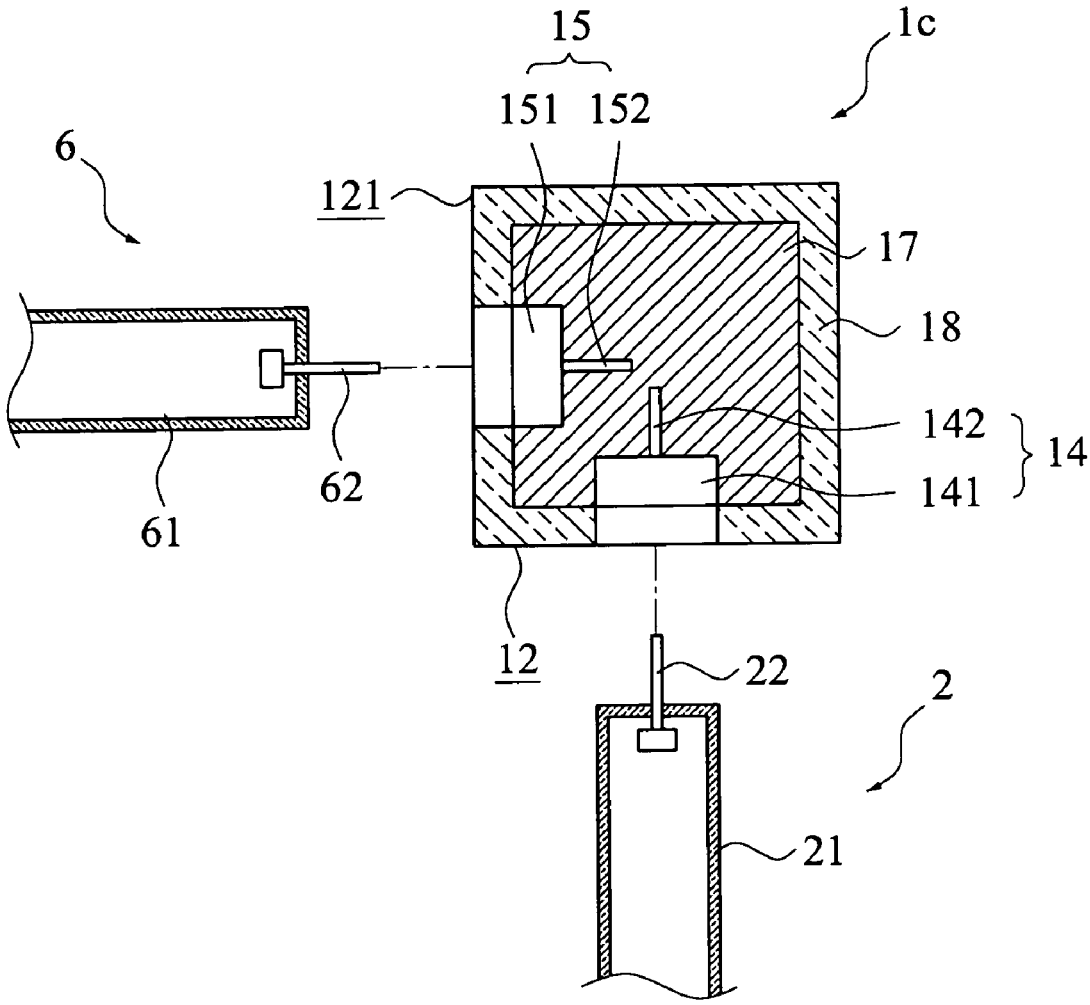
FIG. 11 is a sectional view taken along line 10-10 of FIG. 10.

As can be seen from FIG. 11, the main body 11*c* of the lamp lead wire coupling terminal 1*c* includes an inner conductive body 17 and an outer enclosing insulative layer enclosing the conductive body 17 therein.

The lamp body holding sections 141, 151 of the CCFL sockets 14, 15 are inward extended through the outer enclosing insulative layer 18 into the inner conductive body 17, such that the lamp lead wires 22, 62 held in the lamp lead wire holding sections 142, 152 can be electrically connected to each other via the inner conductive body 17.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A complex coupler for cold cathode fluorescent lamp, comprising:

an outer enclosing insulative layer being formed thereon with at least one cold cathode fluorescent lamp socket and at least one cable socket; and an inner conductive body being enclosed in the outer enclosing insulative layer; and the cold cathode fluorescent lamp socket and the cable socket being inward extended through the outer enclosing insulative layer into the inner conductive body;

wherein the socket is configured for an end of a cold cathode fluorescent lamp and a lamp lead wire provided at that end of the cold cathode fluorescent lamp to insert thereinto and be held thereto, and the cable socket is configured for a cable to insert thereinto, whereby the lamp lead wire of the cold cathode fluorescent lamp can be electrically connected to the cable via the inner conductive body.

2. The complex coupler as claimed in claim 1, wherein the complex coupler is in the shape of an elongated column.

3. The complex coupler as claimed in claim 1, wherein the cable comprises a conductor and a conductor connecting head having a conductor insertion segment.

4. The complex coupler as claimed in claim 3, wherein the conductor is provided with a guide hook.

5. The complex coupler as claimed in claim 3, wherein the conductor insertion segment includes a metal insertion stem, a free end of which functions as an insertion end, and an end of the conductor insertion segment opposite to the metal insertion stem is a conductor welding end, to which the conductor is welded.

6. A complex coupler for cold cathode fluorescent lamp, comprising:

an outer enclosing insulative layer being formed thereon with at least one pair of cold cathode fluorescent lamp sockets; and an inner conducting layer being enclosed in the outer enclosing insulative layer, and the cold cathode fluorescent lamp sockets being inward extended through the outer enclosing insulative layer into the inner conductive body;

wherein each of the cold cathode fluorescent lamp sockets is configured for an end of a cold cathode fluorescent lamp and a lamp lead wire provided at that end of the cold cathode fluorescent lamp to insert thereinto and be held thereto, whereby the lamp lead wires of the cold cathode fluorescent lamps can be electrically connected to each other via the inner conductive body.

7. The complex coupler as claimed in claim 6, wherein the complex coupler is in the shape of an elongated column.

* * * * *